US008364049B2

(12) United States Patent
Fukushi

(10) Patent No.: US 8,364,049 B2
(45) Date of Patent: Jan. 29, 2013

(54) FIXING APPARATUS AND IMAGE FORMING APPARATUS

(75) Inventor: Kenji Fukushi, Kashiwa (JP)

(73) Assignee: Canon Kabushiki Kaisha (JP)

( * ) Notice: Subject to any disclaimer, the term of this patent is extended or adjusted under 35 U.S.C. 154(b) by 329 days.

(21) Appl. No.: 12/878,427

(22) Filed: Sep. 9, 2010

(65) Prior Publication Data

US 2011/0076037 A1 Mar. 31, 2011

(30) Foreign Application Priority Data

Sep. 29, 2009 (JP) ..... 2009-224837

(51) Int. Cl.
*G03G 15/20* (2006.01)

(52) U.S. Cl. ..... 399/33; 219/619; 399/334

(58) Field of Classification Search ..... 399/33, 399/69, 334; 219/216, 619
See application file for complete search history.

(56) References Cited

U.S. PATENT DOCUMENTS

2004/0222216 A1* 11/2004 Kinouchi et al. ..... 219/619
2005/0226662 A1* 10/2005 Sekiguchi et al. ..... 399/334
2006/0088328 A1 4/2006 Yoshimura et al.
2007/0201916 A1* 8/2007 Ueno ..... 399/334

FOREIGN PATENT DOCUMENTS

JP 2000-066543 A 3/2000

* cited by examiner

*Primary Examiner* — Sophia S Chen
(74) *Attorney, Agent, or Firm* — Rossi, Kimms & McDowell LLP

(57) ABSTRACT

A fixing apparatus which heat-fixes a toner image transferred onto a sheet, including: a heating device configured to generate eddy currents in a conductive heating element using a magnetic core and an exciting coil to produce heat; a core moving unit configured to move the core; a current detecting unit configured to detect a current flowing through the exciting coil; and an abnormal signal output unit configured to output a signal indicating an abnormality when a difference between a first current value and a second current value is smaller than a predetermined threshold value, the first current value being detected by the current detecting unit before the core is moved by the core moving unit, the second current value being detected by the current detecting unit after the core is moved by the core moving unit.

8 Claims, 10 Drawing Sheets

FIXING APPARATUS AND IMAGE FORMING APPARATUS

BACKGROUND OF THE INVENTION

1. Field of the Invention

The present invention relates to a fixing apparatus of electromagnetic induction heating method and an image forming apparatus including the fixing apparatus.

2. Description of the Related Art

An image forming apparatus, such as a copying machine, includes a fixing apparatus for fixing toner onto a sheet by thermally fusing the toner transferred onto the sheet. In recent years, a fixing apparatus of an electromagnetic induction heating method has come into use, in which a rotary member (such as a fixing belt) made of thin-walled metal is induced to generate heat through induction heating using an exciting coil. According to the method, magnetic fluxes generated from the exciting coil are passed through a conductive portion of the rotary member so that eddy currents flow within the body of the rotary member, to thereby heat the rotary member through Joule heating generated by the eddy currents.

Further, the fixing apparatus of the electromagnetic induction heating method has magnetic cores disposed therein, in order to enhance convergence of the magnetic fluxes generated from the exciting coil. There has been proposed a fixing apparatus in which a positional relation between the magnetic cores and the exciting coil determines heating efficiency of the rotary member, and the heating efficiency is changed in part by displacing the magnetic cores (see Japanese Patent Application Laid-Open No. 2000-66543). According to the configuration, the magnetic core provided at an end portion of the rotary member is displaced, to thereby perform control so as to prevent heat generation in the end portion (temperature rise in the end portion) of the rotary member when small-sized sheets are continuously supplied.

However, according to the configuration disclosed in Japanese Patent Application Laid-Open No. 2000-66543, in a case where the magnetic core fails to be moved in the event of failure in a drive circuit for driving the magnetic core, the failure in the drive circuit cannot be detected. When the magnetic core disposed at the end portion of the rotary member fails to be moved in position while small-sized sheets are being continuously supplied, the temperature rise in the end portion of the rotary member occurs, with the result that the sheets get wrinkled due to the thermal expansion in the end portion of the rotary member. On the other hand, the productivity decreases if a down sequence of increasing intervals of conveying the sheets is performed in order to prevent the temperature rise in the end portion of the rotary member.

In view of the above, there is a method of providing a sensor for detecting whether or not the magnetic core has moved, on a drive shaft of the magnetic core. In such a case, however, the sensor needs to be disposed at a position close to the fixing apparatus, which means that an expensive heat-resistant sensor must be used.

Meanwhile, there is proposed an apparatus which includes a shutter configured to shield against the magnetic fluxes generated from the exciting coil (US 2006/0088328), in which the shutter is provided in a movable manner and shields against the magnetic fluxes at the end portion of the rotary member, to thereby prevent temperature rise in the end portion of the rotary member. However, even in this case, there is a problem that provision of a sensor for detecting whether or not the shutter has moved results in a cost increase.

SUMMARY OF THE INVENTION

It is an object of the present invention to detect an abnormality in a drive circuit configured to move a magnetic core or a shutter provided in a fixing apparatus of an electromagnetic induction heating method with an inexpensive structure.

In order to achieve the above-mentioned object, according to a first aspect of the present invention, there is provided a fixing apparatus which heat-fixes a toner image transferred onto a sheet, the fixing apparatus including: a heating device configured to generate eddy currents in a conductive heating element using a magnetic core and an exciting coil to produce heat; a core moving unit configured to move the magnetic core; a current detecting unit configured to detect a current flowing through the exciting coil; and an abnormal signal output unit configured to output a signal indicating an abnormality when a difference between a first current value and a second current value is smaller than a predetermined threshold value, the first current value being detected by the current detecting unit before the magnetic core is moved by the core moving unit, the second current value being detected by the current detecting unit after the magnetic core is moved by the core moving unit.

Further, according to a second aspect of the present invention, there is provided a fixing apparatus which heat-fixes a toner image transferred onto a sheet, the fixing apparatus including: a heating device configured to generate eddy currents in a conductive heating element using a magnetic core and an exciting coil to produce heat; a shutter configured to shield against a part of magnetic fluxes generated from the exciting coil; a shutter moving unit configured to move the shutter from a retracted position where the magnetic fluxes are unshielded to a shielding position where the shutter shields against the part of the magnetic fluxes; a current detecting unit configured to detect a current flowing through the exciting coil; and an abnormal signal output unit configured to output a signal indicating an abnormality when a difference between a first current value and a second current value is smaller than a predetermined threshold value, the first current value being detected by the current detecting unit before the shutter is moved by the shutter moving unit, the second current value being detected by the current detecting unit after the shutter is moved by the shutter moving unit.

Further features of the present invention will become apparent from the following description of exemplary embodiments with reference to the attached drawings.

DETAILED DESCRIPTION OF THE EMBODIMENTS

First Embodiment

Figure 1:
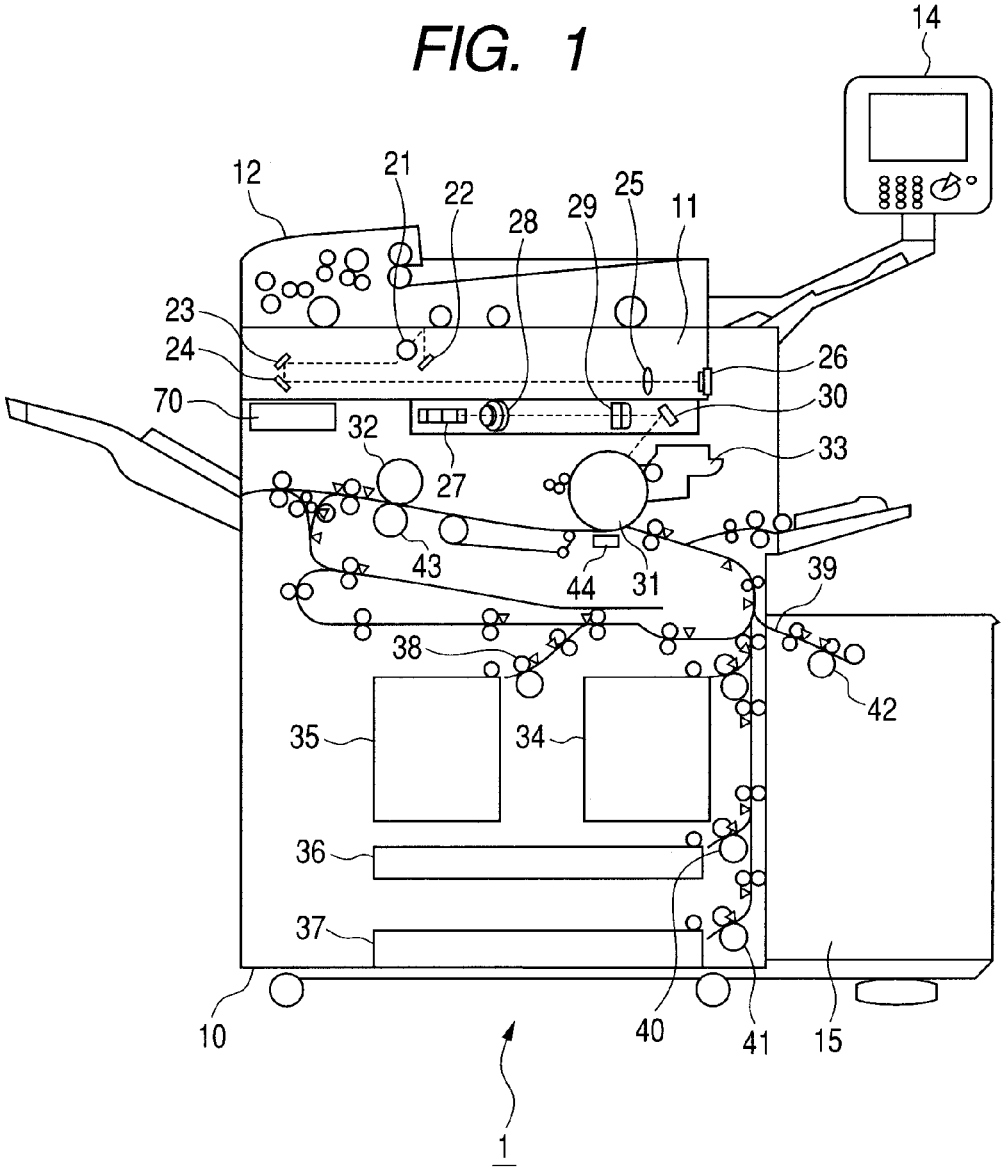
FIG. 1 is an overall configuration diagram illustrating an image forming apparatus 1.

FIG. 1 is an overall configuration diagram illustrating an image forming apparatus 1. The image forming apparatus 1 includes an image output portion 10 configured to form a toner image on a sheet, an image input portion 11 configured to read an original image, and an automatic original transport device 12 provided on the image input portion 11. The image forming apparatus 1 further includes a display portion 14, which allows a user to perform an operation of, for example, setting a copy mode. Further, the display portion 14 may display various settings and a current job status of the image forming apparatus 1.

The image output portion 10 is provided with sheet feeding portions 34, 35, 36, and 37 storing sheets. In each of the sheet feeding portions 34 to 37, the user can freely set sheets according to the sheet size. Further, the image output portion 10 is provided with a large-capacity paper deck 15, which is externally connected to the image output portion 10. Sheets are conveyed in a direction toward a photosensitive drum 31 via a sheet feed conveying roller 38, 39, 40, 41, or 42 driven by a motor (not shown).

In the image input portion 11, an original placed on an original placing table is irradiated with light from a light source 21 which scans in a horizontal direction of FIG. 1. The light emitted from the light source 21 is reflected by the original, and forms an image on a charge-coupled device (CCD) 26 via mirrors 22, 23, and 24 and a lens 25. The CCD 26 converts the formed image into an electric signal, to thereby output digital image data. The image data output from the CCD 26 is subjected to an image conversion, such as scaling, as required by the user, and stored in an image memory in a control portion 70.

When forming an image on a sheet, the control portion 70 reads the image data stored in the image memory, reconverts the image data in the form of a digital signal into an analog signal, and causes an optical irradiation portion 27 to emit a laser beam. The laser beam thus emitted is applied onto the photosensitive drum 31 via a scanner 28, a lens 29, and a mirror 30, to thereby scan a surface of the photosensitive drum 31.

The photosensitive drum 31 has a photoconductive layer formed on the surface thereof, and is rotary driven at a constant speed during a copy job. The photosensitive drum 31 is applied with toner by a developing device 33 filled with toner, so that a toner image is formed on the surface of the photosensitive drum 31. Meanwhile, a sheet is conveyed from one of the sheet feeding portions 34 to 37 along a sheet conveyor path, passes through under the photosensitive drum 31 in keeping with the toner image, so that the toner image on the photosensitive drum 31 is transferred onto the sheet by a transfer charging device 44. The sheet onto which the toner image has been transferred passes through between a fixing belt 32, which is serving as a rotary member, and a drive roller 43, so that the unfixed toner image on the sheet is heat-fixed through fusing. After that, the sheet is delivered outside the image output portion 10.

Figure 2:
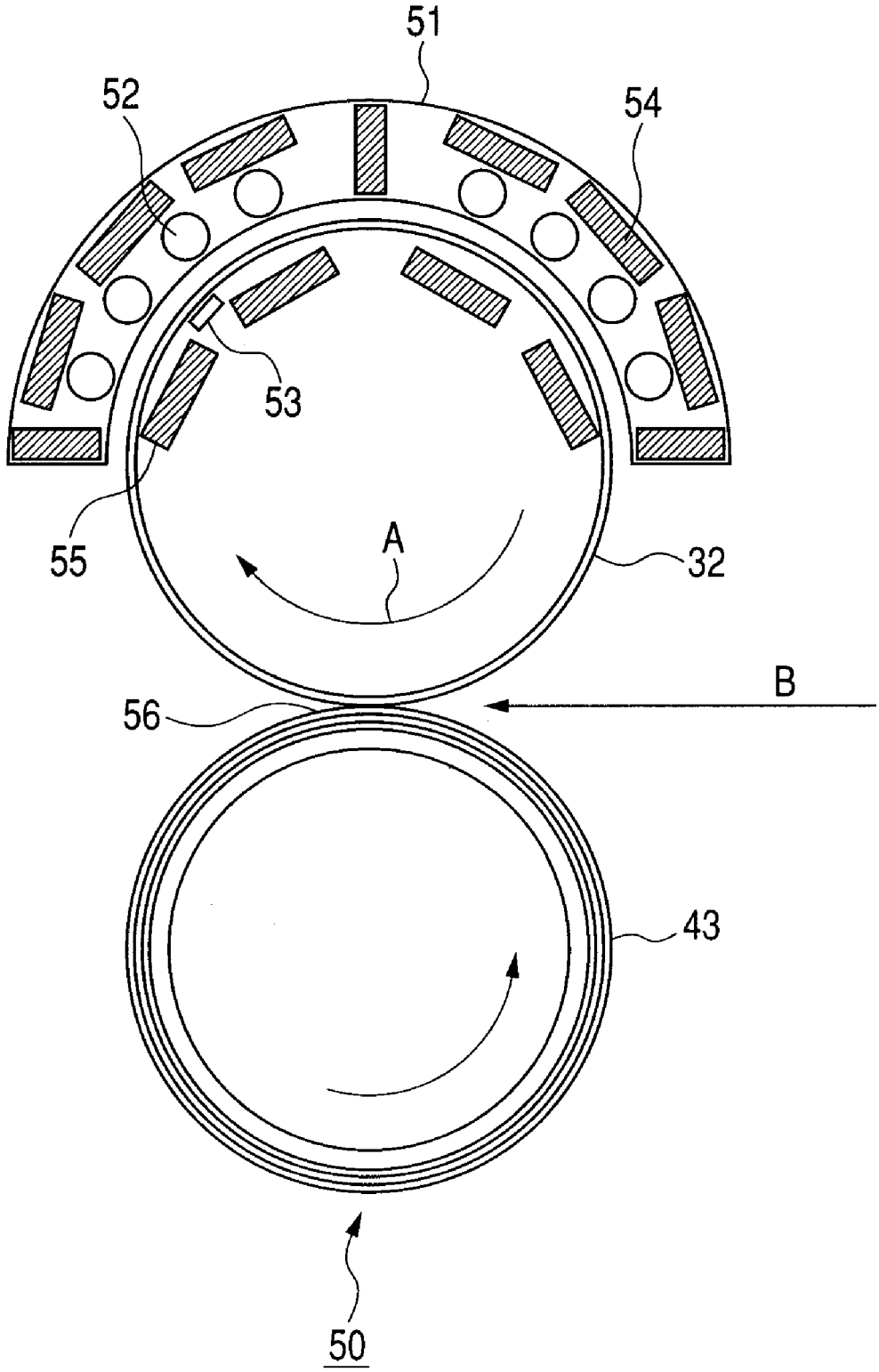
FIG. 2 is a cross-sectional view of a fixing apparatus 50.

FIG. 2 is a cross-sectional view of a fixing apparatus 50. According to the first embodiment, the fixing apparatus 50 employs an external heating-type electromagnetic induction heating method. The fixing belt 32 according to the first embodiment includes a conductive heating element of a thickness of 45 μm. The fixing belt 32 has a surface thereof covered with a rubber layer of a thickness of 300 μm. The fixing belt 32 comes into contact with the drive roller 43, to thereby form a nip portion 56. The drive roller 43 is applied with a drive force by a drive source (not shown), and the drive force is transferred to the fixing belt 32 via the nip portion 56, so that the fixing belt 32 rotates in the direction indicated by the arrow A.

A sheet conveying direction is indicated by the arrow B. Further, an exciting coil 52 is disposed inside a coil holder 51 as being opposed to the fixing belt 32. An alternating current is caused to flow through the exciting coil 52 to generate a magnetic field, to thereby generate eddy currents in the conductive layer of the fixing belt 32 to produce heat. A thermistor 53 contacts with a heat generating portion of the fixing belt 32 from inside, and detects a temperature of the heat generating portion. The alternating current flowing through the exciting coil 52 is controlled so that the temperature detected by the thermistor 53 reaches a target temperature of 180° C. An external core 54 serving as a magnetic core is provided inside the coil holder 51 so as to surround the exciting coil 52. Internal cores 55 are provided inside the fixing belt 32.

Figure 3:
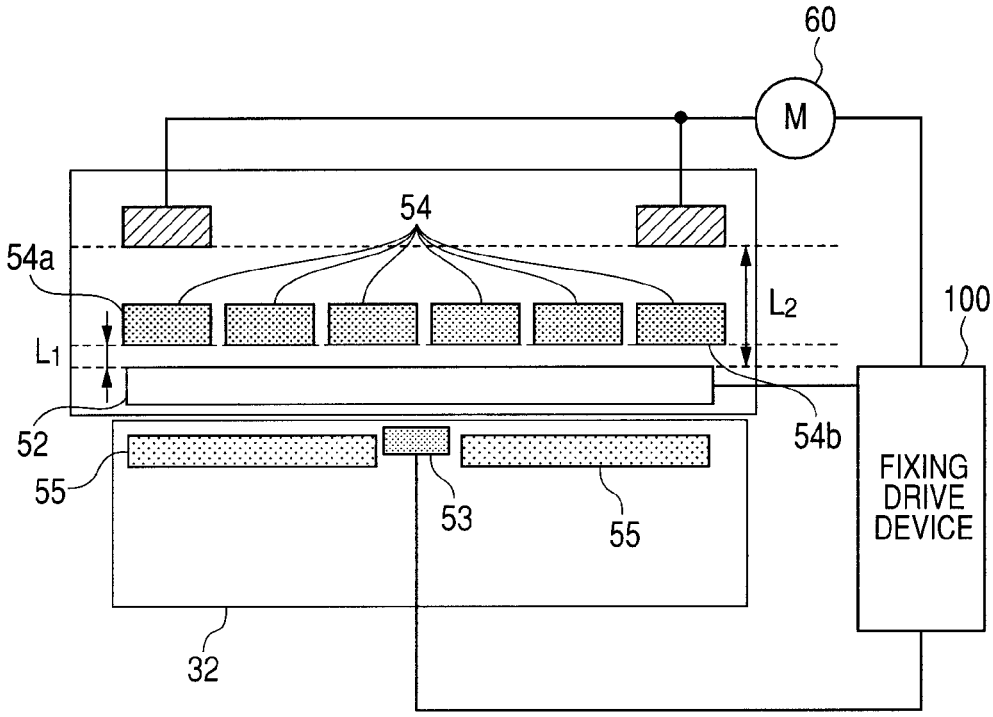
FIG. 3 is a cross-sectional view of the fixing apparatus 50 in a longitudinal direction.

FIG. 3 is a cross-sectional view of the fixing apparatus 50 in a longitudinal direction. Multiple external cores 54 are provided in a direction (width direction) orthogonal to the sheet conveying direction. A fixing drive device 100 controls the alternating current for driving the exciting coil 52. Of the multiple external cores 54, the external cores 54 disposed at both sides are referred to as end cores 54*a* and 54*b*. The fixing drive device 100 performs drive control of a core moving motor 60 for moving the end cores 54*a* and 54*b* closer to or away from the exciting coil 52. The drive control is described later in detail with reference to FIG. 4.

The core moving motor 60 according to the first embodiment has an output shaft connected to the end cores 54*a* and 54*b*, so that the end cores 54*a* and 54*b* may be moved through rotary driving of the core moving motor 60 by a predetermined amount. Here, there is a distance L1 from a standby position of the external cores 54 to the exciting coil 52 when supplying a sheet of a first size (such as A4) in the width direction. Further, there is a distance L2 from a standby position of the end cores 54*a* and 54*b* to the exciting coil 52 when supplying a sheet of a second size (such as A4R), which is smaller than the first size in the width direction which is orthogonal to the sheet conveying direction.

It should be noted that, according to the first embodiment, the motor is employed as the drive source for driving the external cores 54. However, the drive source is not limited to the motor as long as being capable of moving the cores. Further, the first embodiment employs a configuration in which the external cores 54 are moved. Alternatively, however, there may be employed another configuration in which the internal cores 55 are moved. Further, according to the first embodiment, the number of the external cores 54 is six, while the number of the internal cores 55 is two. However, the numbers of the external cores 54 and the internal cores 55 are not specifically limited. Still further, according to the first embodiment, two cores at both ends of the external cores 54 are moved by the core moving motor 60. However, the number of the cores to be moved is not limited to two.

Figure 4:
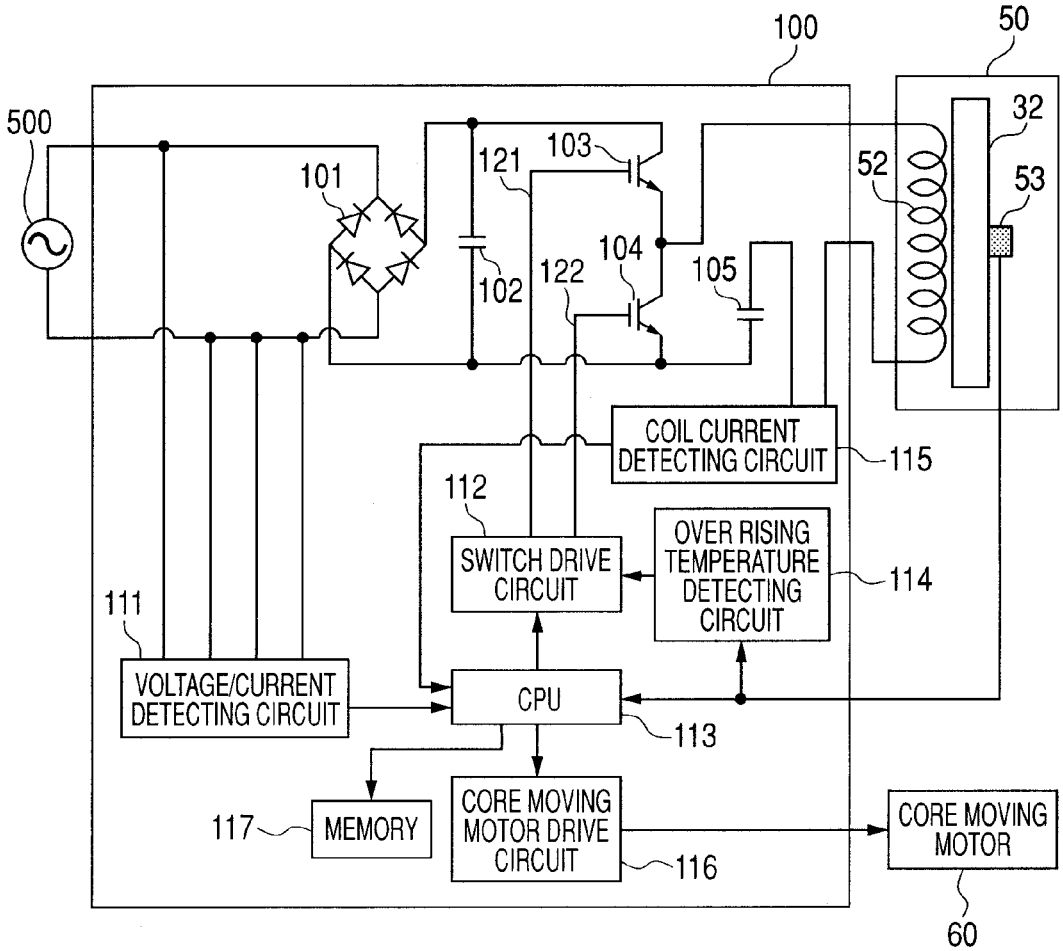
FIG. 4 is a circuit block diagram of the fixing apparatus 50 and a fixing drive device 100.

FIG. 4 is a circuit block diagram of the fixing apparatus 50 and the fixing drive device 100. The fixing drive device 100 is connected to an alternating-current source 500 such as a commercial power, and includes a diode bridge 101, a capacitor 102, a resonance capacitor 105 forming a resonance circuit, and the exciting coil 52. The fixing drive device 100 further includes a first switch element 103, a second switch element 104, a switch drive circuit 112 configured to drive the first and second switch elements 103 and 104 by drive signals 121 and 122, and a voltage/current detecting circuit 111 configured to detect an input voltage and current.

A central processing unit (CPU) 113 is connected to the thermistor 53 configured to detect a temperature of the fixing belt 32, and detects whether or not the temperature detected by the thermistor 53 has reached a predetermined level of over rising temperature. In a case where the temperature detected by the thermistor 53 has reached the predetermined level of over rising temperature, the CPU 113 controls an over rising temperature detecting circuit 114 to output a signal for forcibly stopping the supply of an alternating current to the exciting coil 52, to the switch drive circuit 112. The CPU 113 is also connected to a coil current detecting circuit 115 configured to detect a value of a current flowing into the exciting coil 52.

The CPU 113 varies switching frequencies (drive frequencies) of the drive signals 121 and 122, according to the detection results of the voltage/current detecting circuit 111 and the thermistor 53, so that the temperature of the fixing belt 32 reaches a target temperature with power which falls within a predetermined range of maximum power. The switch elements 103 and 104 are alternately turned on and off according to the drive signals 121 and 122, and a high-frequency current is supplied to the exciting coil 52.

The alternating current flowing through the exciting coil 52 is at a frequency higher than a resonance frequency determined based on inductance values of the exciting coil 52 and the fixing belt 32 and a capacitance value of the resonance capacitor 105. The alternating current increases when the drive frequencies of the drive signals 121 and 122 are decreased, whereas the alternating current decreases when the drive frequencies are increased. The increase or decrease of the alternating current leads to an increase or a decrease in intensity of a magnetic field to be generated, which results in an increase or a decrease in the amount of heat generation in the conductive heating element. In other words, the CPU 113 is capable of controlling the temperature of the fixing belt 32 through the control of the drive frequencies of the drive signals 121 and 122.

Further, the CPU 113 is capable of controlling the core moving motor 60 by supplying a control signal to a core moving motor drive circuit 116 configured to drive the core moving motor 60. A memory 117 is a volatile memory, and connected to the CPU 113.

Figure 5:
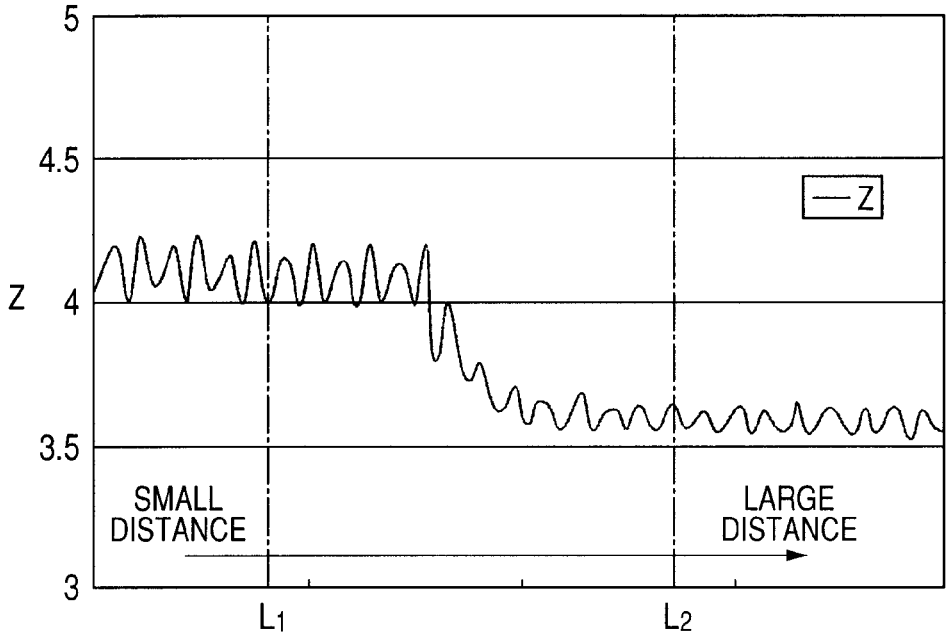
FIG. 5 is a graph illustrating changes in impedance when end cores 54*a* and 54*b* are moved while a drive frequency is maintained constant.

FIG. 5 is a graph illustrating changes in impedance when the end cores 54*a* and 54*b* are moved while the drive frequency is maintained constant. Specifically, FIG. 5 illustrates changes in impedance Z in relation to the fixing drive device 100 when the end cores 54*a* and 54*b* are gradually moved away from the exciting coil 52 while the drive frequency of the switch drive circuit 112 is maintained at about 30 kHz.

The distance L1 is the distance between the standby position of the external cores 54 and the exciting coil 52 when supplying a sheet of the first size (such as A4) in the width direction. Meanwhile, the distance L2 is the distance between the standby position of the end cores 54*a* and 54*b* and the exciting coil 52 when supplying a sheet of the second size (such as A4R), which is smaller than the first size in the width direction. When the external cores 54 are moved away from the exciting coil 52 so that the distance L1 is changed to the distance L2, the impedance is reduced by about 0.5.

Figure 6:
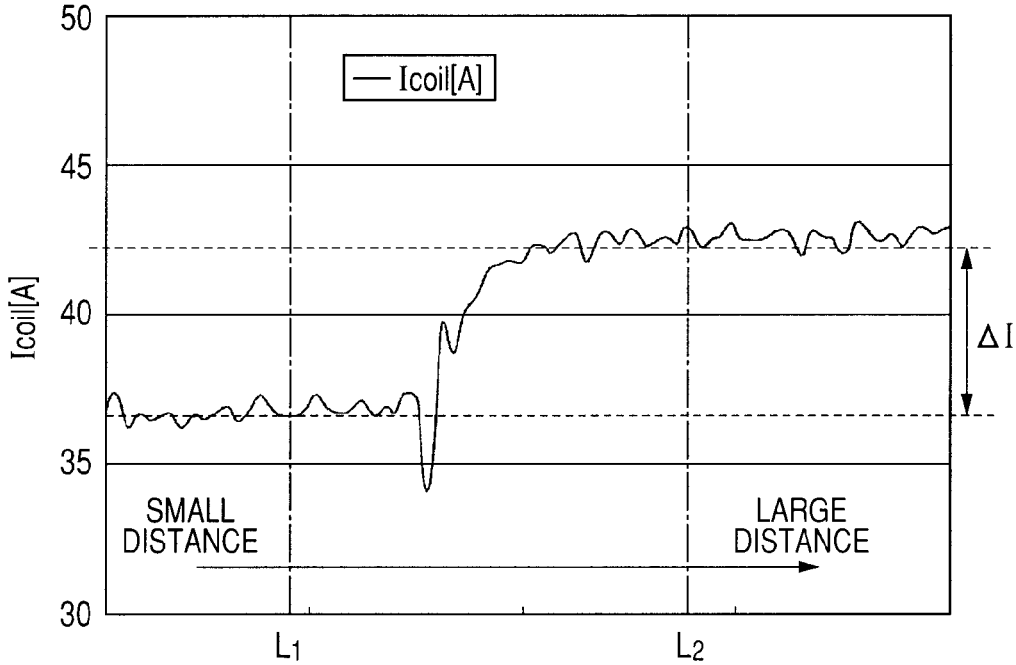
FIG. 6 is a graph illustrating changes in a current flowing through an exciting coil when the end cores 54*a* and 54*b* are moved while the drive frequency is maintained constant.

On the other hand, as illustrated in FIG. 6, a difference ΔI of about 5 A is generated in a current value Icoil detected by the coil current detecting circuit 115 in the fixing drive device 100. According to the difference ΔI, a threshold value Th (of 3 A in the first embodiment) is set. The CPU 113 determines whether or not the amount of change in the current value exceeds the threshold value Th.

Figure 7:
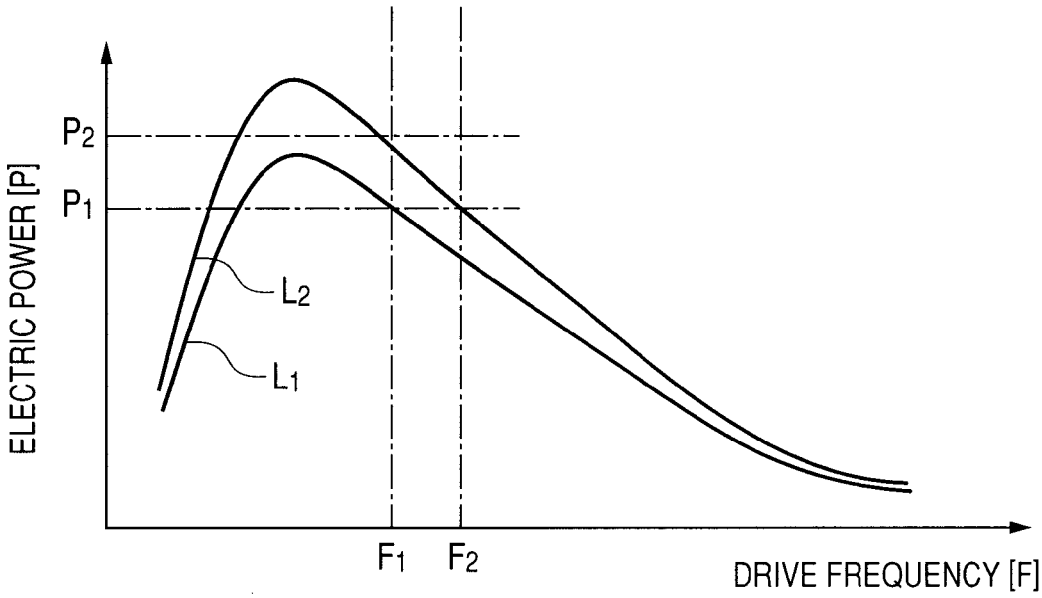
FIG. 7 is a graph illustrating changes in electric power P with respect to a drive frequency F.

FIG. 7 is a graph illustrating changes in electric power P with respect to a drive frequency F, in each of the cases where the distance L1 and the distance L2 are provided from the exciting coil 52 to the end cores 54*a* and 54*b*, respectively. When the exciting coil 52 are driven at the same frequency, the electric power P increases as the external cores 54 are moved further away from the exciting coil 52. For example, an electric power P1 is supplied for driving the exciting coil 52 at a drive frequency $F_1$ (first drive frequency) with the distance L1. However, when the end cores 54*a* and 54*b* are moved in position to provide the distance L2 without changing the drive frequency $F_1$, the electric power P is increased to P2 (>P1), and hence extra power is supplied.

When the electric power is increased in a case where the image forming apparatus 1 is used at total power which is close to the maximum value of the rating capacity of a plug receptacle, there is a fear that the increase in electric power leads to a problem such as tripping of a circuit breaker. In view of this, in a case of moving the external cores 54 from a position of the distance L1 to a position of the distance L2, the drive frequency F needs to be changed to be equal to or larger than $F_2$ (second drive frequency) before moving the external cores 54, so that the electric power P becomes equal to or smaller than P1 when the external cores 54 are moved to the position of the distance L2. On the contrary, when moving the external cores 54 from the position of the distance L2 to the position of the distance L1, the drive frequency $F_2$ needs to be changed to $F_1$ after moving the external cores 54, because there is a risk of a sudden increase in electric power if the drive frequency $F_2$ is changed to $F_1$ before moving the external cores 54.

Figure 8:
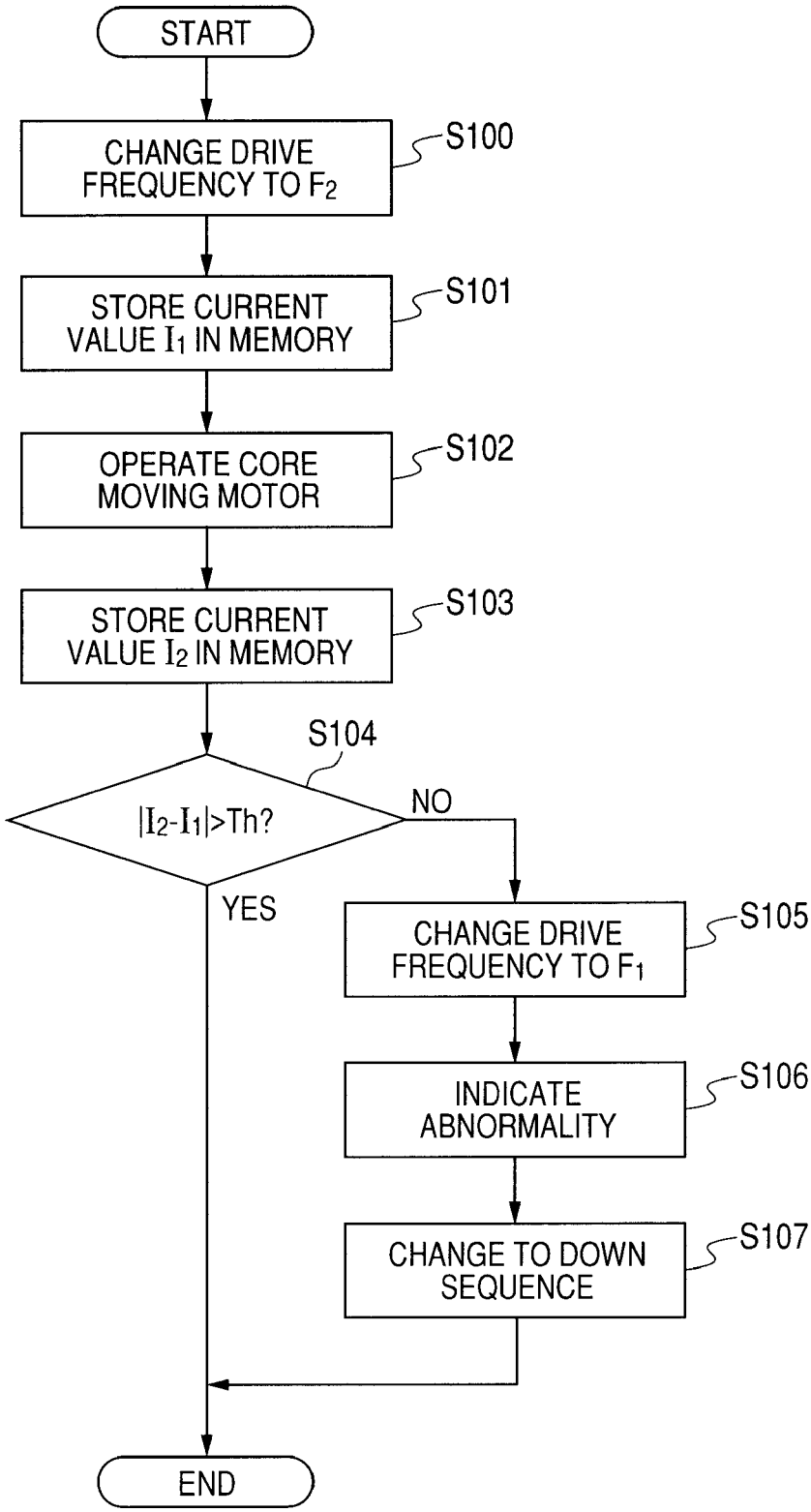
FIG. 8 is a flow chart illustrating an operation to be performed when a sheet size in a width direction is changed from a first size (such as A4) to a second size (such as A4R).

FIG. 8 is a flow chart illustrating an operation to be performed in a case where a sheet size in the width direction is changed from the first size (such as A4) to the second size (such as A4R) when the external cores 54 are driven at $F_1$ of the drive frequency F. The processing illustrated in the flow chart is executed by the CPU 113.

When the sheet size in the width direction is changed from the first size (such as A4) to the second size (A4R), the CPU 113 needs to drive the core moving motor 60 so that the end cores 54*a* and 54*b* are moved away from the exciting coil 52 so as to provide the distance L2 therebetween. For this purpose, the CPU 113 first changes the drive frequency F from $F_1$ to $F_2$ ($F_1>F_2$) (S100). Next, the CPU 113 stores a current value $I_1$ (first current value) flowing through the exciting coil 52 detected by the coil current detecting circuit 115, in the memory 117 (S101).

After that, the CPU 113 drives the core moving motor 60, to thereby move the end cores 54*a* and 54*b* away from the exciting coil 52 so that the distance L2 is provided therebetween (S102). At this time, when a stepper motor is employed as the core moving motor 60, a predetermined number of drive pulses may be output, to thereby determine the travel distance. Alternatively, even when the stepper motor is not employed, the core moving motor 60 may be controlled based on, for example, a drive time corresponding to the distance L2.

When the driving of the core moving motor 60 is completed, the CPU 113 stores, in the memory 117, a current value $I_2$ (second current value) flowing through the exciting coil 52 detected by the coil current detecting circuit 115, while maintaining the drive frequency F constant at $F_2$ (S103). Then, the CPU 113 determines whether or not a difference between the current value $I_1$ and the current value $I_2$ is larger than the predetermined threshold value Th (S104). In this manner, the CPU 113 determines whether or not the amount of change in current value is larger than the threshold value Th, to thereby determine whether or not the amount of change in current flowing through the exciting coil 52 is larger than a predetermined threshold value.

In Step S104, in a case where the difference between the current value $I_1$ and the current value $I_2$ is larger than the predetermined threshold value Th, the CPU 113 ends the process because the end cores 54*a* and 54*b* have been moved normally. Specifically, the CPU 113 performs an operation of forming an image on a sheet of the second size with keeping the drive frequency F at $F_2$ and without changing the drive frequency F.

On the other hand, in a case where the difference between the current value $I_1$ and the current value $I_2$ is equal to or smaller than the predetermined threshold value Th in S104, it is conceivable that the end cores 54*a* and 54*b* have not been moved normally. In this case, the CPU 113 changes the drive frequency F to $F_1$ (S105). Then, the CPU 113 outputs a signal indicating an abnormality to the display portion 14, to thereby cause the display portion 14 to perform a display of an abnormality for notifying a serviceperson that the end cores 54*a* and 54*b* have not been moved normally (S106). If an image is formed on a sheet in the second size in this state, a temperature rise is likely to occur in end portions of the fixing belt 32. Accordingly, the processing is changed to a down sequence of increasing intervals of conveying the sheets so as to suppress the temperature rise in the end portions of the fixing belt 32 (S107).

Figure 9:
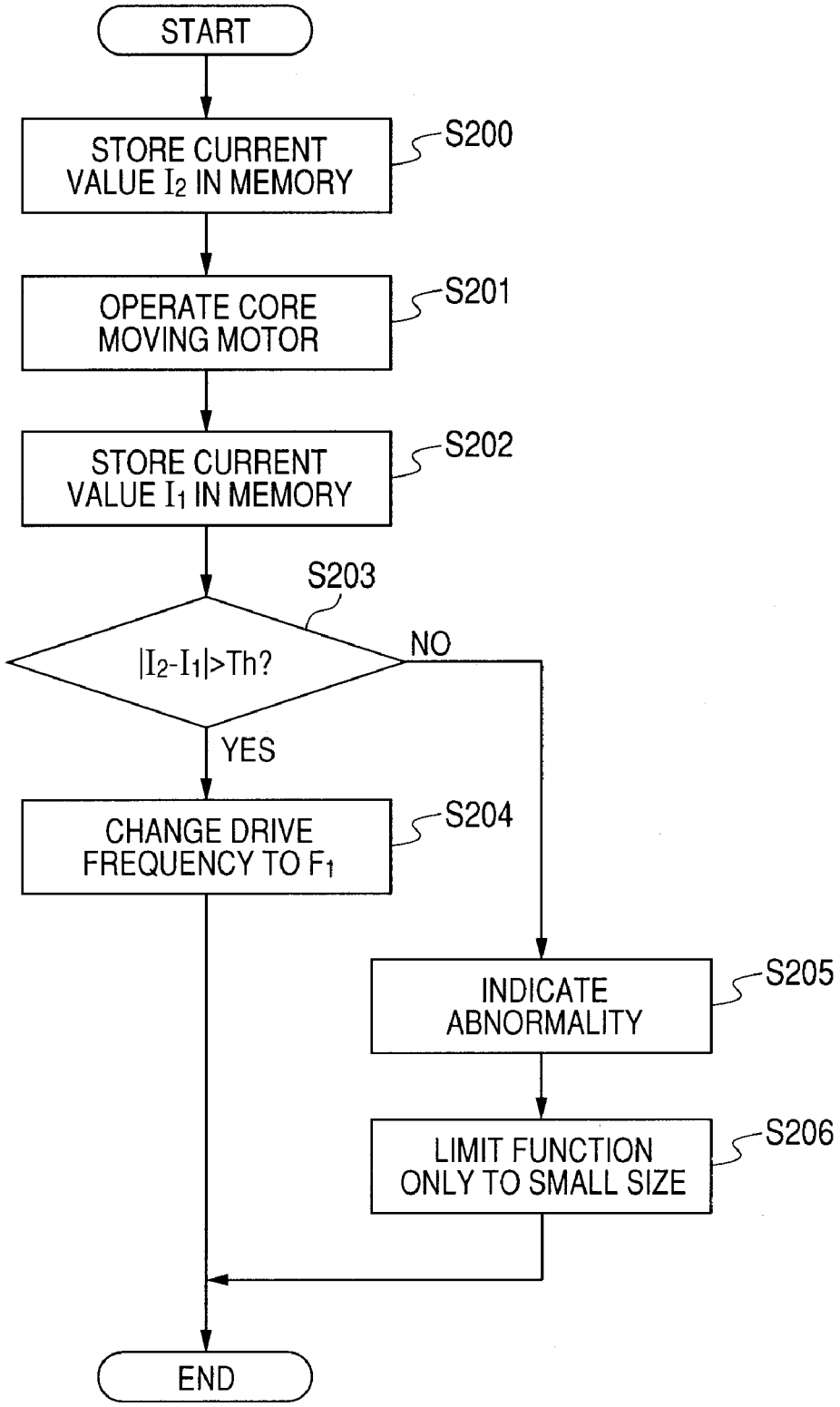
FIG. 9 is a flow chart illustrating an operation to be performed when the sheet size in the width direction is changed from the second size (such as A4R) to the first size (such as A4).

FIG. 9 is a flow chart illustrating an operation to be performed in a case where the sheet size in the width direction is changed from the second size (such as A4R) to the first size (such as A4) when the exciting coil 52 are driven at $F_2$ of the drive frequency F. The processing illustrated in the flow chart is executed by the CPU 113.

When the sheet size in the width direction is changed from the second size (such as A4R) to the first size (such as A4), the CPU 113 needs to drive the core moving motor 60 so that the end cores 54*a* and 54*b* are moved closer to the exciting coil 52 so as to provide the distance L1 therebetween. For this purpose, the CPU 113 first stores, in the memory 117, the current value $I_2$ flowing through the exciting coil 52 detected by the coil current detecting circuit 115, with keeping the drive frequency F at $F_2$ (S200). After that, the CPU 113 drives the core moving motor 60, to thereby move the end cores 54*a* and 54*b* closer to the exciting coil 52 so that the distance L1 is provided therebetween (S201).

Next, the CPU 113 stores, in the memory 117, the current value $I_1$ flowing through the exciting coil 52 detected by the coil current detecting circuit 115, while maintaining the drive frequency F constant at $F_2$ (S202). Then, the CPU 113 determines whether or not the difference between the current value $I_1$ and the current value $I_2$ is larger than the predetermined threshold value Th (S203). In this manner, the CPU 113 determines whether or not the amount of change in current value is larger than the threshold value Th, to thereby determine whether or not the amount of change in current flowing through the exciting coil 52 is larger than a predetermined threshold value.

In Step S203, in a case where the difference between the current value $I_1$ and the current value $I_2$ is larger than the predetermined threshold value Th, the end cores 54*a* and 54*b* have been moved normally. Accordingly, the CPU 113 changes the drive frequency F from $F_2$ to $F_1$ (S204), and ends the process in the flowchart. Specifically, the CPU 113 changes the drive frequency F to $F_1$ and performs an operation of forming an image on a sheet of the first size.

On the other hand, in a case where the difference between the current value $I_1$ and the current value $I_2$ is equal to or smaller than the predetermined threshold value Th in S203, it is conceivable that the end cores 54*a* and 54*b* have not been moved normally. In this case, the CPU 113 outputs a signal indicating an abnormality to the display portion 14, to thereby cause the display portion 14 to perform a display of an abnormality for notifying a serviceperson that the end cores 54*a* and 54*b* have not been moved normally (S205). If an image is formed on a sheet of the first size in this state, the end portions of the sheet are not applied with sufficient heat, which results in a fixing failure. Accordingly, limitations are imposed on a function so that an image cannot be formed on a sheet of the first size, so as to form an image only on a sheet of the second size (S206).

As described above, according to the first embodiment, in a case where the amount of change in current, which is obtained when moving the end cores 54*a* and 54*b* by the core moving motor 60, is equal to or smaller than a predetermined threshold value, the CPU 113 serving as an abnormal signal output unit outputs a signal indicating an abnormality. With this configuration, the fixing apparatus 50 of electromagnetic induction heating method may be configured to be capable of detecting, at low cost, an abnormality in the core moving motor 60, which is provided in the fixing apparatus 50, for moving the external cores 54.

Second Embodiment

According to the first embodiment, description has been provided of a configuration in which the end cores 54*a* and 54*b* are moved so as to prevent a temperature rise from occurring at the end portions of the fixing belt 32. In contrast, according to a second embodiment of the present invention, a shutter 67 illustrated in FIG. 10 is moved, instead of moving the end cores 54*a* and 54*b*, to thereby shield the end portions of the fixing belt 32 against magnetic fluxes.

Figure 10:
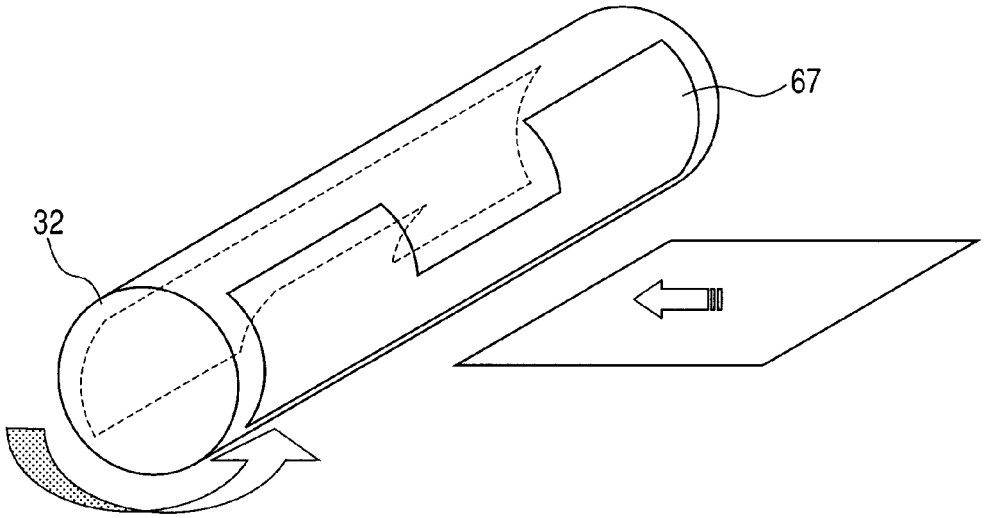
FIG. 10 is a diagram illustrating an operation of a shutter.

FIG. 10 is a diagram illustrating an operation of the shutter 67. The shutter 67 is disposed between the exciting coil 52 and the fixing belt 32. The shutter 67 is usually retracted to a position rendered in solid lines (retracted position) of FIG. 10. In a case of shielding against magnetic fluxes converged by the external cores 54, the shutter 67 is rotated by 180 degrees to a position rendered in dotted lines (shielding position) of FIG. 10, to thereby shield against magnetic fluxes reaching the fixing belt 32. The shutter 67 is configured to be in a shape which is capable of shielding the both end portions of the fixing belt 32 against magnetic fluxes, while allowing the magnetic fluxes to pass therethrough at the central portion. The shutter 67 may be made of copper or aluminum, which is low in magnetic permeability.

Figure 11:
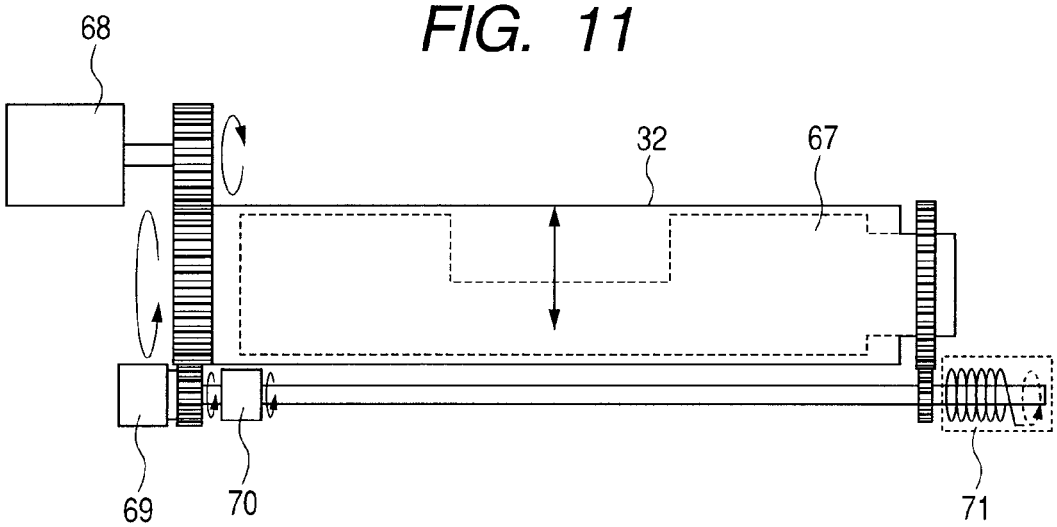
FIG. 11 is a diagram illustrating a drive configuration of the shutter.

FIG. 11 is a diagram illustrating a drive configuration of the shutter 67. As illustrated in FIG. 11, the shutter 67 is usually retracted to the retracted position by a shutter take-up mechanism 71. When a shutter drive clutch 69 is driven, torque transferred from a shutter moving motor 68 is transmitted to a gear coupled to the shutter 67, which causes the shutter 67 to move to the shielding position against a reactive force exerted by the shutter take-up mechanism 71. The shutter 67 abuts against a positioning portion after moving to an operating position. After that, a drive force transmitted from the drive source is slipped by a torque limitter 70. The shutter 67 is configured to be brought back to the retracted position by the shutter take-up mechanism 71 when the clutch 69 is stopped.

Figure 12:
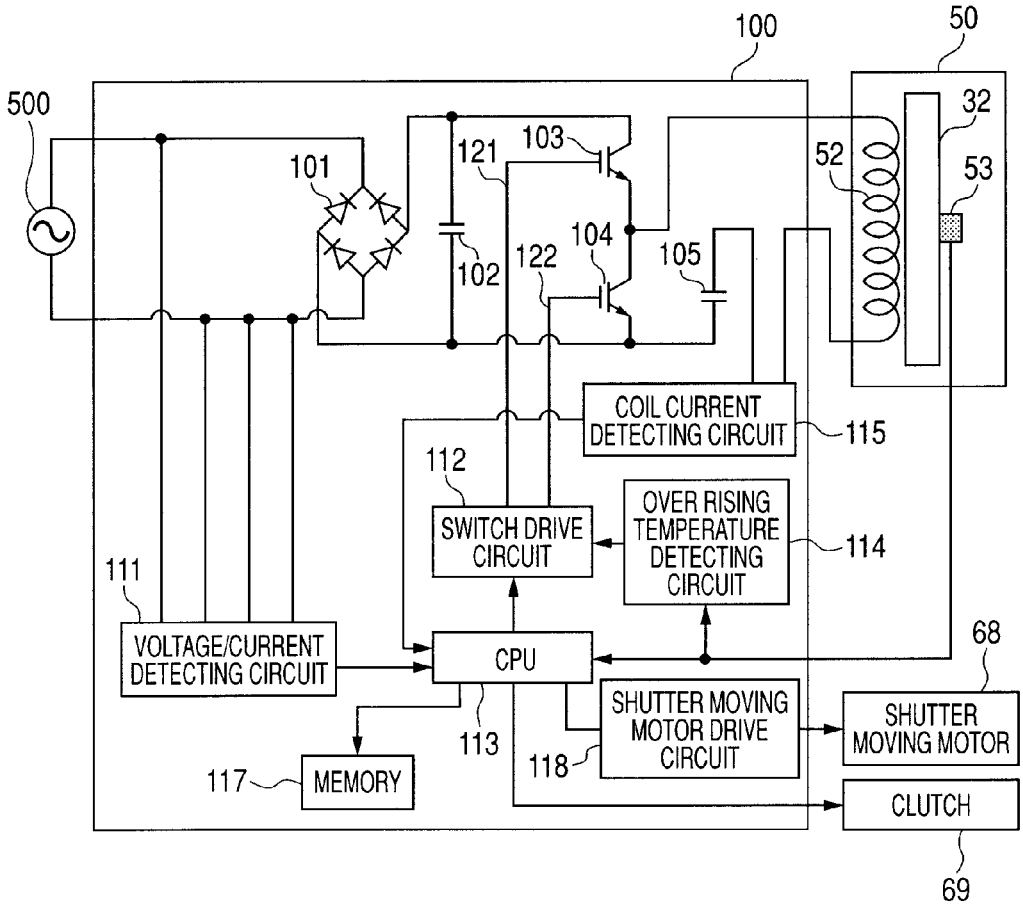
FIG. 12 is a circuit block diagram of a fixing apparatus 50 and a fixing drive device 100 according to a second embodiment of the present invention.

FIG. 12 is a circuit block diagram of a fixing apparatus 50 and a fixing drive device 100 according to the second embodiment. The CPU 113 outputs a control signal to a shutter moving motor drive circuit 118 for causing the shutter moving motor drive circuit 118 to drive the shutter moving motor 68. Further, the CPU 113 performs control on an operation of the clutch 69. The rest of the circuit configurations are similar to that of the first embodiment, and hence the description thereof is omitted.

According to the first embodiment, the CPU 113 controls the core moving motor 60 so that the distance from the exciting coil 52 to the end cores 54*a* and 54*b* is increased (Step S102 of FIG. 8 and Step S201 of FIG. 9). On the other hand, according to the second embodiment, the CPU 113 drives the shutter moving motor 68 and the clutch 69, instead of moving the end cores 54*a* and 54*b*, so that the shutter 67 is moved from the retracted position to the shielding position.

Then, the CPU 113 detects, based on a signal from the coil current detecting circuit 115, a current value $I_1$ (first current value) flowing through the exciting coil 52 when the shutter 67 is in the retracted position, and a current value $I_2$ (second current value) flowing through the exciting coil 52 when the shutter 67 is in the shielding position. When a difference between the current value $I_1$ and the current value $I_2$ is equal to or smaller than a predetermined threshold value Th, it is conceivable that the shutter 67 has not been moved normally. In this case, the CPU 113 outputs a signal indicating an abnormality to the display portion 14, to thereby cause the display portion 14 to perform a display of an abnormality for notifying a serviceperson that the shutter 67 has not been moved normally.

As described above, according to the second embodiment, in a case where an amount of change in current obtained when moving the shutter 67 by the shutter moving motor 68 is equal to or smaller than a predetermined threshold value, the CPU 113 outputs the signal indicating the abnormality. With this configuration, the fixing apparatus 50 of the electromagnetic induction heating method may be configured to be capable of detecting, at low cost, an abnormality in the shutter moving motor 68 which is provided to the fixing apparatus 50.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-224837, filed Sep. 29, 2009, which is hereby incorporated by reference herein in its entirety.

What is claimed is:

1. A fixing apparatus which heat-fixes a toner image transferred onto a sheet, the fixing apparatus comprising:

a heating device configured to generate eddy currents in a conductive heating element using a magnetic core and an exciting coil to produce heat;

a core moving unit configured to move the magnetic core;

a current detecting unit configured to detect a current flowing through the exciting coil; and an abnormal signal output unit configured to output a signal indicating an abnormality when a difference between a first current value and a second current value is smaller than a predetermined threshold value, the first current value being detected by the current detecting unit before the magnetic core is moved by the core moving unit, the second current value being detected by the current detecting unit after the magnetic core is moved by the core moving unit.

2. A fixing apparatus according to claim 1, further comprising a control unit configured to control a drive frequency for driving the exciting coil, wherein, when detecting the first current value and the second current value by the current detecting unit, the magnetic core is moved by the core moving unit in a state where the drive frequency of the exciting coil is maintained constant by the control unit.

3. A fixing apparatus according to claim 2, wherein the magnetic core comprises a plurality of magnetic cores provided in a width direction orthogonal to a sheet conveying direction, and the core moving unit moves, of the plurality of magnetic cores, magnetic cores at ends in the width direction, in a direction away from the exciting coil, according to a sheet size of the sheet in the width direction orthogonal to the sheet conveying direction.

4. A fixing apparatus according to claim 3, wherein, in a case of changing the sheet size in the width direction of the sheet passing through the fixing apparatus from a first sheet size to a second sheet size smaller than the first sheet size, the core moving unit moves the magnetic cores at the ends in the direction away from the exciting coil after the drive frequency of the exciting coil is changed by the control unit from a first drive frequency to a second drive frequency smaller than the first drive frequency.

5. A fixing apparatus according to claim 4, wherein, in a case of changing the sheet size in the width direction of the sheet passing through the fixing apparatus from the second sheet size to the first sheet size, the control unit changes the drive frequency of the exciting coil from the second drive frequency to the first drive frequency after the magnetic cores at the ends are moved by the core moving unit in a direction getting closer to the exciting coil.

6. A fixing apparatus which heat-fixes a toner image transferred onto a sheet, the fixing apparatus comprising:

a heating device configured to generate eddy currents in a conductive heating element using a magnetic core and an exciting coil to produce heat;

a shutter configured to shield against a part of magnetic fluxes generated from the exciting coil;

a shutter moving unit configured to move the shutter from a retracted position where the magnetic fluxes are unshielded to a shielding position where the shutter shields against the part of the magnetic fluxes;

a current detecting unit configured to detect a current flowing through the exciting coil; and an abnormal signal output unit configured to output a signal indicating an abnormality when a difference between a first current value and a second current value is smaller than a predetermined threshold value, the first current value being detected by the current detecting unit before the shutter is moved by the shutter moving unit, the second current value being detected by the current detecting unit after the shutter is moved by the shutter moving unit.

7. An image forming apparatus, comprising:

a transfer unit configured to transfer a toner image onto a sheet;

a heating device configured to generate eddy currents in a conductive heating element using a magnetic core and an exciting coil to produce heat, to thereby heat the toner image transferred onto the sheet;

a core moving unit configured to move the magnetic core;

a current detecting unit configured to detect a current flowing through the exciting coil; and an abnormal signal output unit configured to output a signal indicating an abnormality when a difference between a first current value and a second current value is smaller than a predetermined threshold value, the first current value being detected by the current detecting unit before the magnetic core is moved by the core moving unit, the second current value being detected by the current detecting unit after the magnetic core is moved by the core moving unit.

8. An image forming apparatus, comprising:

a transfer unit configured to transfer a toner image onto a sheet;

a heating device configured to generate eddy currents in a conductive heating element using a magnetic core and an exciting coil to produce heat, to thereby heat the toner image transferred onto the sheet;

a shutter configured to shield against a part of magnetic fluxes generated from the exciting coil;

a shutter moving unit configured to move the shutter from a retracted position where the magnetic fluxes are unshielded to a shielding position where the shutter shields against a part of the magnetic fluxes;

a current detecting unit configured to detect a current flowing through the exciting coil; and an abnormal signal output unit configured to output a signal indicating an abnormality when a difference between a first current value and a second current value is smaller than a predetermined threshold value, the first current value being detected by the current detecting unit before the shutter is moved by the shutter moving unit, the second current value being detected by the current detecting unit after the shutter is moved by the shutter moving unit.

* * * * *